United States Patent [19]

Jones et al.

[11] Patent Number: 4,668,348

[45] Date of Patent: May 26, 1987

[54] METHOD FOR FORMING ADHERENT, BRIGHT, SMOOTH AND HARD CHROMIUM ELECTRODEPOSITS ON FERROUS METAL SUBSTRATES FROM HIGH ENERGY EFFICIENT CHROMIUM BATHS

[75] Inventors: Allen R. Jones, Belford; Hyman Chessin, Brick, both of N.J.

[73] Assignee: M&T Chemicals Inc., Woodbridge, N.J.

[21] Appl. No.: 780,469

[22] Filed: Sep. 26, 1985

[51] Int. Cl.[4] ..... C25D 5/36

[52] U.S. Cl. ..... 204/34; 204/32.1; 204/51

[58] Field of Search ..... 204/32.1, 34, 51, 145 R

[56] References Cited

U.S. PATENT DOCUMENTS

| | | | |
|---|---|---|---|
| 3,532,608 | 10/1970 | Serra | 204/28 |
| 3,726,773 | 4/1973 | Lamb et al. | 204/129.35 |
| 3,840,441 | 10/1974 | Hees et al. | 204/34 |
| 4,093,522 | 6/1978 | Dillenberg | 204/51 |
| 4,234,396 | 11/1980 | Perakh et al. | 204/51 |
| 4,412,892 | 11/1973 | Chen et al. | 204/34 |
| 4,416,738 | 11/1983 | Herrmann, Jr. | 204/32 R |
| 4,450,050 | 5/1984 | Chessin et al. | 204/41 |
| 4,472,249 | 9/1984 | Chessin | 204/51 |

OTHER PUBLICATIONS

Metal Finishing and Guidebook for 1978, Metals and Plastics Publications, Inc., Hackensack, N.J., pp. 130–131, 160–164.

*Primary Examiner*—John F. Niebling
*Assistant Examiner*—William T. Leader
*Attorney, Agent, or Firm*—S. H. Parker; J. Matalon; R. Bright

[57] ABSTRACT

An activation solution is provided for forming adherent chromium electrodeposits on metal substrates, preferably ferrous metals such as cast iron, from high energy efficient chromium baths. The solution suitably is a mixture of sulfuric acid, added sulfate ion, and an inorganic oxidizing agent. A preferred solution contains 10 to 40% by volume concentrated sulfuric acid, 100 to 200 grams per liter of magnesium sulfate heptahydrate and 1 to 2 grams per liter of sodium nitrate.

14 Claims, No Drawings

METHOD FOR FORMING ADHERENT, BRIGHT, SMOOTH AND HARD CHROMIUM ELECTRODEPOSITS ON FERROUS METAL SUBSTRATES FROM HIGH ENERGY EFFICIENT CHROMIUM BATHS

BACKGROUND OF THE INVENTION

1. Field of the Invention

This invention relates to electrodeposition of chromium on basis metals, and, more particularly, it is concerned with an activation process by which an adherent chromium electrodeposit is formed on ferrous metal substrates using a high energy efficient chromium plating bath.

2. Description of the Prior Art

The use of high efficiency chromium plating baths which contain halides has been hampered by the inability to obtain adequate coating adhesion to certain basis metals. Such baths are disclosed in Mitsui, J7B-33941 (Sept., 1978); Dillenberg U.S. Pat. No. 4,093,522; Perakh et al., U.S. Pat. No. 4,234,396; and Chessin, U.S. Pat. Nos. 4,450,050 and 4,472,249.

In order to obtain an adequate bond on ferrous substrates, as measured by ASTM B 571-79, with conventional chromium plating solutions which comprise a solution of chromic acid and a catalyst such as sulfate, in combination with various fluorides, the usual technique is to reverse or anodically etch the ferrous workpiece in the plating solution, or in a separate chromic acid containing solution, at a predetermined current density and for a predetermined time.

A table which gives suitable lengths of time for such an etching process is found in "Metal Finishing" 80 (5) 65-8 (1982) by C. H. Peger. The use of certain sulfuric acid and hydrofluoric acid etches for specific stainless steels also is suggested in the publication.

Anodic chromic acid treatments for 400 stainless steel alloys and for low and high carbon steels is disclosed in "48th Metal Finishing Guidebook-Directory" 78, 188-202 (1980) by A. Logozzo. Also recommended are cathodic treatments in sulfuric-fluoride solutions for 300 stainless, for nickel alloys and for cast iron.

An alternative procedure in the prior art is the use of a Woods nickel strike for certain special nickel and cobalt-based alloys. (Boeing Aircraft) BAC5709-5.2j(1).

The use of a ferric chloride-hydrochloric acid solution as a clearing agent for the smut produced by anodic sulfuric etches is disclosed at page 137 of "Hard Chromium Plating" Robert Draper Ltd., Teddington, 1964 by J. D. Greenwood.

Brune and McEnally in "Plating" 42, 1127-32 (1955) describe the use of a magnesium sulfate-sulfuric acid anodic etch solution for preparing ferrous parts for plating. Similarly, ASTM Specification B-242-49T suggests the application of an anodic etch using a sulfuric acid solution containing sodium sulfate. ASTM B177-68 describes the use of sulfuric acid or chromic acid as an activator for chromium electroplating on steel for engineering use.

Chessin in U.S. Pat. No. 4,450,050 describes an activation pretreatment for bonding high efficiency chromium electrodeposits on a metal substrate which is characterized by the pre-step of plating the substrate metal with iron or an iron alloy from an iron salt containing bath.

Herrmann, in U.S. Pat. No. 4,416,758, activates metal substrates in an aqueous alkaline cyanide containing solution using current which is periodically reversed, followed by rinsing and chromium plating.

Cast iron substrates present a particular problem with respect to forming adherent chromium deposits. Several references describe pretreatments for cast iron but neither recommends them for use in chromium plating. *Canning Handbook on Electroplating* (W. Canning, Ltd., Birmingham, England) 1973, p. 338 and 345. *Electroplating and Engineering Handbook* (Reinhold) 1955, p. 167. The Graham's method is a pickling or immersion process and does not use electrolysis. Canning proposes a solution which contains chromium acid which is disadvantageous because it creates a waste treatment problem.

It has been found that when these procedures are employed with halide containing high energy efficient chromium plating baths, most ferrous metal substrates are not adequately plated because of inadequate adhesion. It can be speculated that the reducing conditions at the cathode at the initiation of deposition cause the halide ion to be reduced to a form which interferes with the molecular bonding of the chromium to the substrate. In any event, the use of high efficiency chromium plating is limited by the problem of inadequate adhesion.

Accordingly, it is an object of this invention to provide an improved process for forming adherent bright, smooth and hard chromium electrodeposits, particularly from high energy efficient chromium baths on metal substrates, particularly on ferrous metals such as cast irons.

Still another object is to provide an activation solution for electrolytically, preferably anodically, etching a ferrous metal substrate in preparation for electrodepositing an adherent bright, smooth and hard chromium metal deposit thereon from a high energy efficient chromium bath, where the degree of adherence of the chromium deposit can be predetermined by the composition and concentration of the solution.

SUMMARY OF THE INVENTION

It has now been found that the adherence problems encountered with the prior art systems for electrodepositing chromium on metal substrates from high energy efficient chromium electroplating baths can be overcome through the use of a process in which a metal substrate is subjected to an activation step in an activation solution which includes sulfuric acid, added sulfate ion, and an inorganic oxidizing agent. Suitably, the activation solution contains 10 to 50% by volume of concentrated sulfuric acid, 0.25 to 2 moles/l of added sulfate ion, and $3.5\times10^{-3}$ to $140\times10^{-3}$ moles/l of an inorganic oxidizing agent, such as nitrate, permanganate, perchlorate or persulfate.

The process herein is particularly useful in that it is capable of forming adherent, bright, smooth and hard chromium electrodeposits on ferrous metal substrates from a high energy efficient chromium plating bath, that is, one which includes a halide ion therein.

DETAILED DESCRIPTION OF THE INVENTION

While the process of the invention can be utilized for electrodepositing chromium from any chromium bath, it can be used advantageously for forming adherent chromium deposits on a metal substrate from a high energy efficient chromium bath which includes a halide ion as an essential constituent. The presence of the halide ion in such baths can cause problems with adherence of the chromium deposit unless the metal substrate is given a suitable pretreatment such as the pretreatment of the invention.

The process of the present invention comprises subjecting the metal substrate to electrolytic, preferably anodic, etching in a solution of sulfuric acid, added sulfate ion, and an oxidizing agent, rinsing the activated substrate, and electrodepositing chromium thereon, preferably from a high energy efficient chromium bath.

Suitably the activation solution consists essentially of 10 to 50% by volume of concentrated sulfuric acid, 0.25 to 2 moles/l. of added sulfate ion, and $3.5\times10^{-3}$ to $140\times10^{-3}$ moles/l of an inorganic oxidizing agent.

Preferably, the activation solution consists essentially of 20 to 40% by volume concentrated sulfuric acid, 0.4 to 1 mole/l of added sulfate ion and $7.0\times10^{-3}$ to $70\times10^{-3}$ moles/l of oxidizing agent.

Typically, the activation solution consists essentially of 20 to 40% by volume of concentrated sulfuric acid, 100 to 200 g/l of magnesium sulfate and 1 to 2 g/l of sodium nitrate.

Suitable inorganic oxidizing agents for use in the activation solution of the invention include oxygenated inorganic oxidizing agents, such as nitrate, permanganate, perchlorate, persulfate and molybdate ions, usually added as the sodium or potassium salts. Chromate is not as useful since it gives a rough deposit.

The added sulfate ion usually is present as magnesium sulfate heptahydrate which is very soluble in the activation solution.

The electrolytic etching step is carried out for about 10 seconds to 10 minutes, preferably 15 seconds to 1 minute, at a current density of about 1.5 amps/dm$^2$ to 155 amps/dm$^2$ (asd), preferably 1 to 8 amps/dm$^2$ and at a temperature from about 10° C. to 40° C., preferably at room temperature.

After the activation step, the current is turned off and the activated metal substrate is transferred to a rinsing vessel where it is rinsed free of the activation solution, preferably within 1 minute after activation. Then the metal substrate is placed in the chromium electroplating bath and chromium metal is deposited thereon.

Optionally, a reverse (i.e. the workpiece is made the anode) in a chromic acid-containing solution, for example, the chromium plating solution itself, may be used preceding the actual chromium plating operation.

Typical metal substrates include ferrous metals such as cast irons and alloy and high carbon steels.

The invention will now be described with reference to the following examples, which are not to be construed as limiting of the invention.

EXAMPLE 1

An activation solution was prepared from 40% by volume of concentrated sulfuric acid, 100 g/l magnesium sulfate heptahydrate, and 0.5 g/l of sodium nitrate. A cast iron substrate was placed in the solution and the substrate was anodically etched at 15.5 asd for 1 minute at 16° C. After transfer to a cold water rinsing bath, the activated metal was chromium plated in a high energy efficient bath containing iodide ion at 77.5 asd for 60 minutes. The chromium deposit exhibited excellent adherence to the substrate and was bright, smooth and hard.

A similar process in the absence of sodium nitrate provided only very poor adhesion of chromium on the cast iron metal substrate.

EXAMPLE 2

The activation solution consisted of 40% by volume of concentrated sulfuric acid, 100 g/l of magnesium sulfate heptahydrate and 2 g/l of sodium nitrate. The substrate was cast iron. Activation was carried out at 21° C. at 77.5 asd for 20 seconds, followed by rinsing and high energy chromium plating at 77.5 for 15 minutes. The adherence of the chromium to the substrate was excellent, the deposit was quite smooth, bright and hard.

EXAMPLE 3

The process of Example 2 was repeated using 40% by volume of concentrated sulfuric acid, 100 g/l of magnesium sulfate heptahydrate, and 5 g/l of sodium nitrate as the activation solution, and anodically etching at 77.5 asd for 15 seconds at 12° C. An excellent adhering deposit was obtained.

EXAMPLE 4

The process of Example 2 was repeated using an activation solution of 40% by volume of concentrated sulfuric acid, 100 g/l of magnesium sulfate heptahydrate, and 1 g/l sodium perchlorate. Activation was carried out at 77.5 asd for 15 seconds. An adherent, smooth chromium deposit was obtained.

EXAMPLE 5

The process of the above examples was repeated using similar molar amounts of potassium permanganate, sodium persulfate and sodium molybdate in place of sodium nitrate. A similar advantageous adherent deposit of chromium was obtained.

While the mechanism of action of the activation solution and process of the present invention is unknown at present, it is believed to reside in the dissolution of carbide particles in the cast iron substrate during the anodic etching step, which provides a smooth substrate for subsequent chromium deposition thereon.

Although the invention has been described with reference to certain preferred embodiments thereof, it will be understood that changes and modifications may be made which are within the skill of the art. Accordingly it is intended to be bound only by the appended claims.

What is claimed is:

1. A method of forming an adherent, bright, smooth and hard chromium deposit on a metal substrate comprising the steps of:

(a) activating said substrate by electrolytic etching in an activation solution consisting essentially of 10 to 50% by volume of concentrated sulfuric acid, 0.25 to 2 moles/l of added sulfate ion, and $3.5\times10^{-3}$ to $140\times10^{-3}$ moles/l of an inorganic oxidizing agent, (b) rinsing the activated substrate, and (c) electrodepositing chromium on said thus-treated substrate.

2. A method according to claim 1 wherein the activation solution consists essentially of 20 to 40% by volume of concentrated sulfuric acid, 0.4 to 1 mole/l of added sulfate ion, and $7.0\times10^{-3}$ to $70\times10^{-3}$ moles/l of an inorganic oxidizing agent.

3. The method according to claim 1 in which said oxidizing agent is nitrate ion.

4. A method according to claim 1 in which said oxidizing agent is permanganate ion.

5. A method according to claim 1 in which said oxidizing agent is perchlorate ion.

6. A method according to claim 1 in which said oxidizing agent is persulfate ion.

7. A method according to claim 1 in which said oxidizing agent is molybdate ion.

8. A method according to claim 1 in which chromium is deposited from a high energy efficient chromium bath which contains a halide selected from iodide, bromide and chloride, or mixtures thereof.

9. A method according to claim 1 in which said substrate is a ferrous metal substrate.

10. A method according to claim 1 in which said added sulfate is magnesium sulfate heptahydrate.

11. A method according to claim 1 in which said rinsing step is carried out within 1 minutes after activation.

12. A method according to claim 1 in which said oxidizing agent is an oxygenated inorganic oxidizing agent selected from the group consisting of nitrate, permanganate, perchlorate, persulfate and molybdate ions.

13. A method according to claim 1 in which the activation step is carried out for about 10 seconds to 10 minutes at a current density of about 1.5 to 155 amps/dm$^2$ at a temperature between about 10° C. to 40° C.

14. A method according to claim 1 in which said electrolytic etching of the substrate is anodic etching.

* * * * *